US006575073B2

(12) United States Patent
McNulty, Jr. et al.

(10) Patent No.: US 6,575,073 B2
(45) **Date of Patent: *Jun. 10, 2003**

(54) METHOD AND APPARATUS FOR IMPLEMENTING A TWO PROJECTILE ELECTRICAL DISCHARGE WEAPON

(76) Inventors: James F. McNulty, Jr., 1290 3rd St., Calimesa, CA (US) 92320; Timothy Lee Whelan, 1027 1/2 California St., Calimesa, CA (US) 92320; Kenneth Alan Nickey, 296 E. Avenue L, Calimesa, CA (US) 92320; Be Tu McNulty, 1290 3rd St., Calimesa, CA (US) 92320

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/569,431

(22) Filed: May 12, 2000

(65) Prior Publication Data

US 2002/0170418 A1 Nov. 21, 2002

(51) Int. Cl.[7] ..... B64D 1/04
(52) U.S. Cl. ..... 89/1.11; 42/84
(58) Field of Search ..... 89/1.11; 361/232; 42/84

(56) References Cited

U.S. PATENT DOCUMENTS

| | | | | | |
|---|---|---|---|---|---|
| 4,253,132 | A | * | 2/1981 | Cover | 361/232 |
| 5,654,867 | A | * | 8/1997 | Murray | 361/232 |
| 5,698,815 | A | * | 12/1997 | Ragner | 102/502 |
| 5,747,719 | A | * | 5/1998 | Bottesch | 340/574 |
| 5,786,546 | A | * | 7/1998 | Simson | 102/438 |
| 5,936,183 | A | * | 8/1999 | McNulty | 89/1.11 |
| 5,955,695 | A | * | 9/1999 | McNulty | 89/1.11 |
| 6,053,088 | A | * | 4/2000 | McNulty, Jr. | 89/1.11 |
| 6,256,916 | B1 | * | 7/2001 | McNulty | 42/1.08 |
| 6,269,726 | B1 | * | 8/2001 | McNulty | 89/1.11 |

* cited by examiner

*Primary Examiner*—Michael J. Carone
*Assistant Examiner*—M Thomson
(74) *Attorney, Agent, or Firm*—Leonard Tachner

(57) ABSTRACT

An improved electrical discharge weapon having a longer range of effectiveness than conventional TASER® weapons. In a preferred embodiment, the improvement comprises an adaptor having dual spaced-apart dart cartridges which, because of their relative spacing and angular orientation, provide an effective range of 2 to 30 feet. The adaptor is configured to be connected to the single cartridge receiver of a conventional TASER® weapon.

2 Claims, 5 Drawing Sheets

METHOD AND APPARATUS FOR IMPLEMENTING A TWO PROJECTILE ELECTRICAL DISCHARGE WEAPON

BACKGROUND OF THE INVENTION

1. Field of the Invention

This invention relates generally to the field of non-lethal weapons for immobilizing a live target for capture and more specifically to such a weapon having two projectiles and configured for long distance usage. Wires tethered to a high voltage source, employ a pair of connectors to apply the voltage across the target, the distance between the connecters on the target being the result of divergence of the connectors in flight.

2. Prior Art

TASER® is the trademark for currently manufactured ballistic weapons which output electrical power pulses to immobilize and capture human and other animal assailants and which have a lower lethality than conventional firearms. Beginning in the late 1970's, law enforcement agencies began to employ TASER weapons as a firearm substitute in certain confrontational situations which could otherwise have justified the use of deadly force, for example against knife wielding assailants at close range. These agencies have also employed the TASER weapon successfully to avoid injury to peace officers, assailants, and innocent bystanders in situations where the use of conventional firearms would have been either impractical or unjustified. The TASER weapon's characteristic near instantaneous incapacitating power, has been employed to disable an assailant holding jagged glass to a hostage's throat without any physical injury occurring to the hostage. It has also been used to prevent a raging parent from hurling his infant from a high rise and to prevent a suicidal man from leaping from a high rise and to subdue unarmed combatants without serious physical injury to the peace officer or assailant. TASER weapons also prevent heartbreak to family and/or friends, and the expense to the community for medical treatment, lost time, and/or the permanent disability of previously productive community members. Moreover, unlike conventional firearms, the TASER weapon can be used to thwart air highjackings without the risk of an errantly discharged projectile depressurizing the cabin.

Numerous United States patents have issued for ballistic and manual contact electrical capture weapons. For example, U.S. Pat. No. 3,523,538 to Shimzu; U.S. Pat. No. 3,803,463 to Cover; U.S. Pat. No. 4,253,132 to Cover; U.S. Pat. No. 4,688,140 to Hammes; U.S. Pat. No. 5,193,048 to Kaufman et al; U.S. Pat. No. 5,473,501 to Claypool; U.S. Pat. No. 5,654,867 to Murray; U.S. Pat. No. 5,698,815 to Ragner; and U.S. Pat. No. 5,831,199 to McNulty et al.

Experiments reported in U.S. Pat. No. 5,841,622 also issued to McNulty, established that the TASER weapon connectors must be spaced a sufficient distance apart on a human or animal target if the targets are to be reliably incapacitated by the weapon's pulsed electrical output. The minimum spread that can reliably disable, is presumed to be 7 inches.

The TASER weapon was originally conceived as a hand-held and potentially concealable device. One purpose of the TASER weapon was to create an easily concealable weapon of light weight, which could be employed to thwart aircraft highjackings without risk of a weapon projectile penetrating and depressurizing the aircraft with ensuing catastrophic consequences. Accordingly, as a practical matter, the electrically opposing projectiles which were contained with their trailing wires in a single compact ammunition round, could not be adequately spaced apart from each other upon leaving the launching portion of the weapon. The weapon's developers, therefore, designed the weapon so that projectiles and their trailing wires would continuously spread apart from each other while in flight between the weapon's launching device and the target.

As manufactured to date, the TASER weapon's receivers contain one or more ports into which an ammunition cartridge is inserted. When the TASER is activated, a common propellant expels from dual bores in the single cartridge, two electrically conductive darts whose trailing conductive wires are attached to the TASER weapon's electrical power supply. The darts depart through separate exit bores which have diameters of 6 mm and which are spaced approximately 6 mm apart from each other. One exit bore is positioned along the horizontal plane of the launcher. The second exit bore is in a position spaced vertically from the first bore and propels a dart at an acute angle relative to the other dart. The bore's angle originates within the cartridge. As the darts leave their respective bores, they continuously spread an increasing distance from each other as they approach the target. When the darts strike a human target, high voltage, low amperage, and low power electrical pulses of brief period, pass through the target between the darts and as a result of the electrical current's physiological effect upon the skeletal muscle and/or pain compliance, the target experiences a temporary ambulatory incapacitation.

This method of establishing the darts' divergence from each other has a serious drawback. It greatly limits the TASER weapon's range. Both minimum and maximum range are limited. For example, the bore axes of current TASER weapons intersect within the cartridge at an angle of 12 degrees. Therefore, for every 5 feet the dart connectors travel toward the target, the connectors will spread approximately 1 foot further apart from each other. If the connectors contact a target within 2.8 feet of the flight path from the launcher, the TASER weapon would not likely be effective at disabling the target. The minimum effective spread of seven inches between the connectors would not yet have been achieved. At a distance of 15 feet from the launcher, the connectors are spread approximately 3 feet apart and would not likely both embed in a human or small animal target to complete the circuit. The TASER weapon's best operational range is from 3 to 12 feet. Increasing the effective spread between the connectors at close range, causes a corresponding undesired increase in the spread of the connectors at long range. Decreasing the spread between the connectors at maximum range decreases the connector's effective spread at closer ranges. Thus, long range effectiveness is sacrificed for close range effectiveness and vice versa. The weapon, therefore, has limited tactical application.

U.S. Pat. No. 5,654,867 to Murray, FIG. 12 and more specifically FIG. 13, illustrates the operation of existing TASER ammunition cartridges. Current, through the circuits detonating branch, ignites the ammunition's primer and propels darts 27 and the pin from the ammunition. The release of the propellant and the subsequent flight of darts 27 to a remote conducting target, act to first switch off the detonating branch of the circuit and, then, to mechanically extend the branch to a remote conducting target where it is reconnected through the target and switched back on. As illustrated, constrained by the length of the TASER receiver's ammunition chamber (see FIG. 1, item 20 of the Murray patent), when the electrically opposed darts first exit the ammunition's bores, they are insufficiently distant from each other to effectively disable a human target (as actually manufactured, only 6 mm apart at the bores).

Therefore, it is highly desirable to provide a weapon for immobilization and capture with extended range capabilities, broader tactical application, and, therefore, application to a larger number and wider range of otherwise potentially lethal capture situations.

SUMMARY OF THE INVENTION

The invention comprises an improvement for a weapon containing a high tension power supply of the type described in U.S. Pat. No. 4,253,132 issued to John Cover or an adapter for such receiver. The receiver or adapter also contains two ports, one positioned above the other along a vertical line. The invention comprises two cartridges, one cartridge intended for insertion into a first port and the other cartridge intended for insertion into the remaining unoccupied port. Each cartridge contains a single projectile within a bore and an independently dischargeable propellant. The projectile is electrically connected to the receiver's power supply by a conductive tether. One or both of the ports and/or the cartridge bores may be but are not necessarily positioned so that the projectiles are propelled from their respective bores at an angle of flight relative to each other. In one embodiment the cartridges are connected to the high tension supply in electrical series, so they can be synchronously electrically detonated to propel the tethered projectiles to near simultaneously strike a human or other animal target while using that conductive target to close a target disabling circuit. Series connection maintains a desirably constant current for detonation of both propellant charges. The detonating series circuit opens upon exit of the projectiles from the launcher and connects to the target as a series circuit. This switching of current from the ammunition detonating circuit of the electrical discharge to a target disabling circuit, existing in parallel relation to the ammunition detonating circuit, provides the weapon with improved range capabilities. This parallel arrangement of the weapon's detonating and target disabling circuits allows the electrically opposed contacts of the target disabling circuit to be spaced a greater distance at the weapon receiver than the electrically opposed contacts of the detonating circuit, thus rendering the weapon more effective at close range while maintaining or improving long range effectiveness. Current TASER weapons have no such means of switching current between a detonating circuit and a circuit established in parallel relation to the detonating circuit by the connection of the conductively tethered ammunition projectiles to a remote conducting target.

When the cartridges of the invention are essentially parallel to each other and not propelled from their respective bores at an angle of flight relative to each other, they may be placed a sufficient distance apart on the launcher to accommodate a disabling spread of the projectiles immediately upon their exit from the launcher. This spread of the parallel launched projectiles should remain essentially constant during the flight of the projectiles from the launcher to the target. The weapon range is limited only by gravitational effects and accommodation of safe force factors.

In a second embodiment the projectiles are electrically connected to the high tension power supply in electrical parallel, so they can be electrically detonated near simultaneously to propel the tethered projectiles to near simultaneous human or other animal target impact while using that conductive target to close a target disabling circuit. The parallel circuit maintains a constant voltage at each propellant charge. This is more desirable than a series connection for detonation of certain kinds of propellants by certain methods of electrical detonation. The parallel circuit opens upon exit of the projectiles from the launcher and connects to the target as a series circuit. This parallel arrangement of the weapon's detonation and target disabling circuits allows the electrically opposed projectile contacts of the target disabling circuit to be spaced a greater distance at the weapon receiver than the electrically opposed contacts of the detonating circuit, thus rendering the weapon more effective at close range while maintaining or improving long range effectiveness. Current TASER weapons have no such parallel arranged circuits. The opening of the parallel circuit also allows the device to act as a manual contact weapon if the potential series circuit does not connect at the target or the target connected series circuit opens. Current TASER weapons have no such adequately spaced manual contacts for a peace or correction officer's protection in the event of a failure of the ballistic delivery systems deployment, absent the addition of expensive, remote, cumbersome and girth increasing parallel circuitry. With current TASER weapons, the target is not exposed to the electrical discharge which in the event of a ballistic deployment failure completes through an atmospheric gap of less than 2 inches in the activated firing bay, absent the addition of the earlier described parallel circuitry. The improved weapon remains small enough to be conveniently portable. Additionally, this dual cartridge, single application, configuration greatly increases the effective disabling range of the weapon as described hereinafter.

The vertical height of this dual cartridge, single application improved weapon with increased range can be further reduced and the weapon made even more compact, if the lines of the improved weapon's projectile containing cartridge bores intersect to form a flight orienting angle behind the cartridges. This allows the projectiles to exit the launching weapon along a vertical line up to several feet into the diverging horizontal flight path established by the angle for the paired projectiles. Accordingly, a smaller angle will accommodate a smaller spread of the projectiles at an established maximum range. Therefore, a greater maximum range can be used without sacrificing weapon effectiveness at close range and, even, while improving weapon effectiveness at close range. The minimum and maximum projectile spreads are established by the distance between the projectile-containing bores along the earlier described vertical line and the angle of the bore lines. For example, for bore lines that are just 5 inches apart along the described vertical line and the angle of the bore lines is just 5 degrees, the projectiles can travel along a horizontal flight path for 30 feet before diverging 36.38 inches from each other. Yet, the projectiles would have an effective spread of 7.09 inches when they had flown only 2 feet horizontally from the launching weapon. This configuration of the improved weapon thus has an effective range between 2 and 30 feet. This is compared with the conventional TASER weapon's effective range of between 3 and 15 feet. The improved weapon with or without angled bore paths remains small enough to be conveniently portable.

The invention also comprises a method for switching current from the ammunition detonating circuit of an electrical discharge weapon to a target disabling circuit, existing in parallel relation to the weapon's ammunition detonation circuit. This parallel arrangement of the weapon's detonation and target disabling circuits allows the electrically opposed contacts of the target disabling circuit to be spaced a greater distance at the weapon receiver than the electrically opposed contacts of the detonating circuit, thus rendering the weapon more effective at close range while maintaining or improving long range effectiveness.

OBJECTS OF THE INVENTION

It is therefore a principal object of the invention to provide a dual cartridge electrical discharge non-lethal weapon for temporarily disabling a live target at a remote distance.

It is another object of the invention to provide a dual cartridge adaptor for addition to a conventional TASER® weapon for increasing the effective range of the weapon.

It is still an additional object of the present invention to provide a dual cartridge adaptor configured to be inserted into the cartridge receiver of a conventional TASER weapon to provide a shorter minimum effective range and a longer maximum effective range.

It is yet an additional object of the invention to provide a method for current switching which renders an electrical discharge weapon effective at close range while improving long range effectiveness.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF PREFERRED EMBODIMENTS

Figure 1:
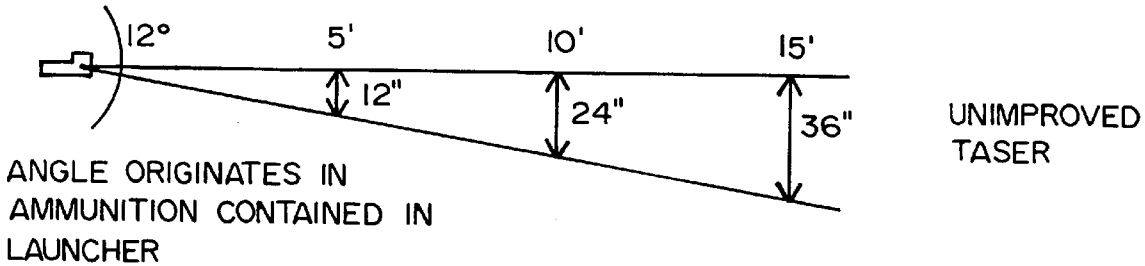
FIG. 1 is a graphical indication of the trajectories of dart projectiles in a conventional electrical discharge weapon for disabling remote targets.
Figure 2:
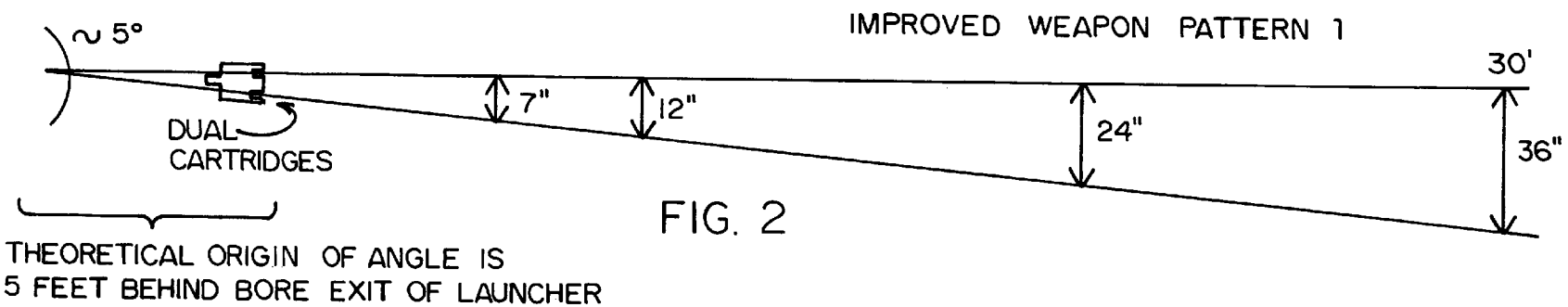
FIG. 2 is a graphical indication similar to FIG. 1 but relating to the invention hereof.
Figure 3:
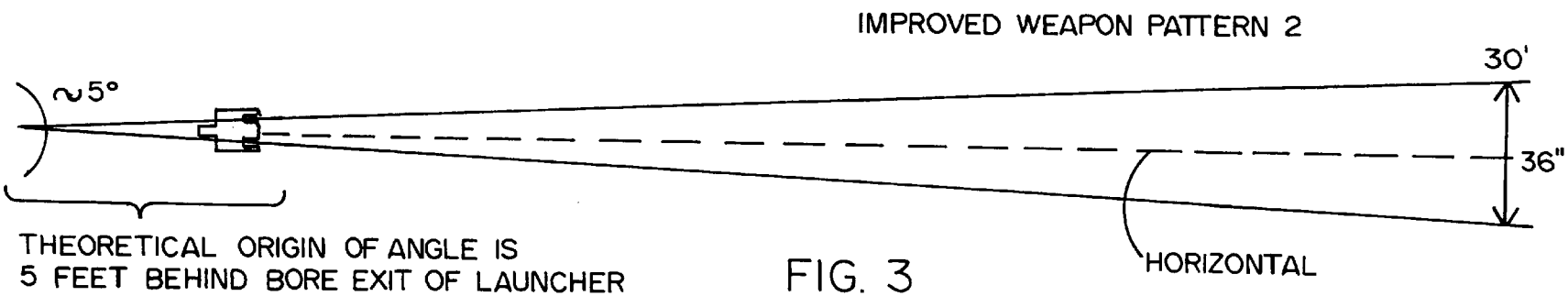
FIG. 3 is a graphical indication similar to FIG. 2.

FIG. 1 illustrates that in a conventional TASER weapon, the effective range has a maximum of about 15 feet and a minimum of about 3 feet. FIGS. 2 and 3 illustrate that in the improved configuration with the dual cartridge adaptor of the improved inventive embodiment illustrated herein, the maximum effective range is increased to 30 feet and the minimum effective range is improved to 2 feet.

Figure 4:
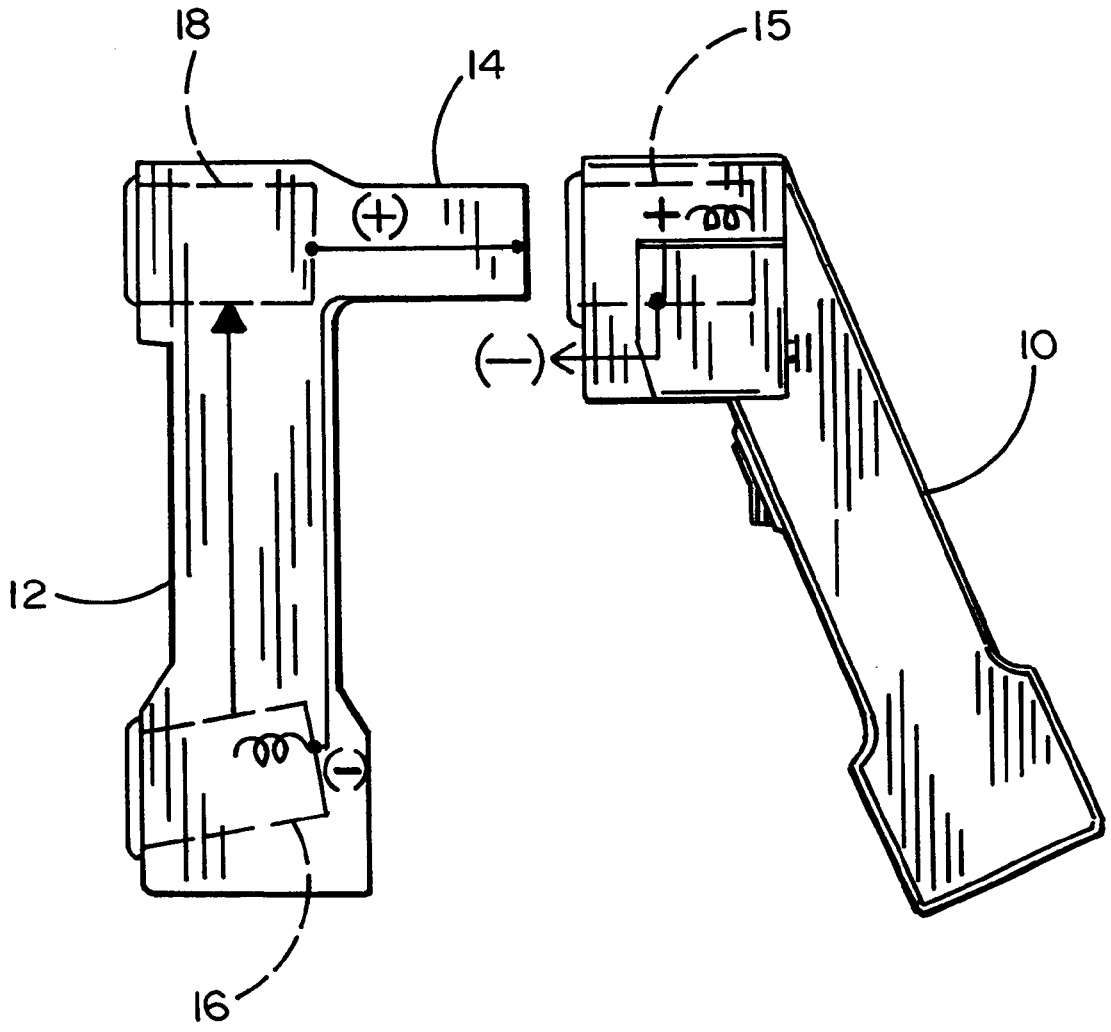
FIG. 4 is a side view illustrating the interconnecting relation of the inventive adaptor and a conventional TASER weapon.

In FIG. 4 it is seen that a conventional TASER® weapon 10 is improved by the addition of an adaptor 12. A connector 14 is inserted into the receiver 15 of the TASER weapon 10 to electrically connect the two spaced-apart weapon chambers 16 and 18 to the power supply circuit of the TASER weapon while eliminating or greatly increasing the air gap between the weapon's breakdown electrodes and thereby, increasing the improved weapon's penetrating arc.

Figure 5:
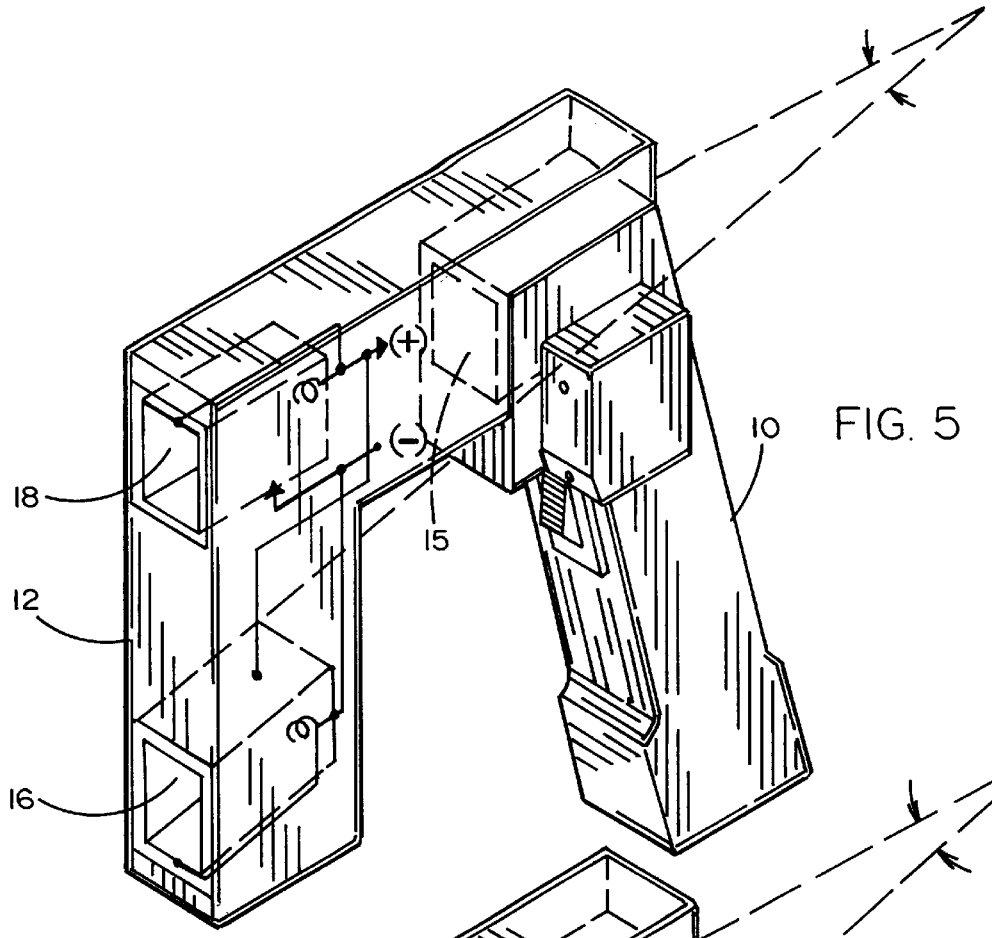
FIGS. 5 and 6 illustrate alternative embodiments of an angled cartridge configuration of an assembled adaptor/TASER.

FIG. 5 illustrates the fully interconnected adapter 12 and weapon 10 with the adapter inserted into receiver 15. Cartridges (not shown) inserted into weapon chambers 16 and 18 are configured mechanically at an angle of about 5 degrees and are configured electrically in parallel. When both darts hit a target, a series connection which exists in parallel configuration with the detonation circuit is created through the target.

Figure 6:
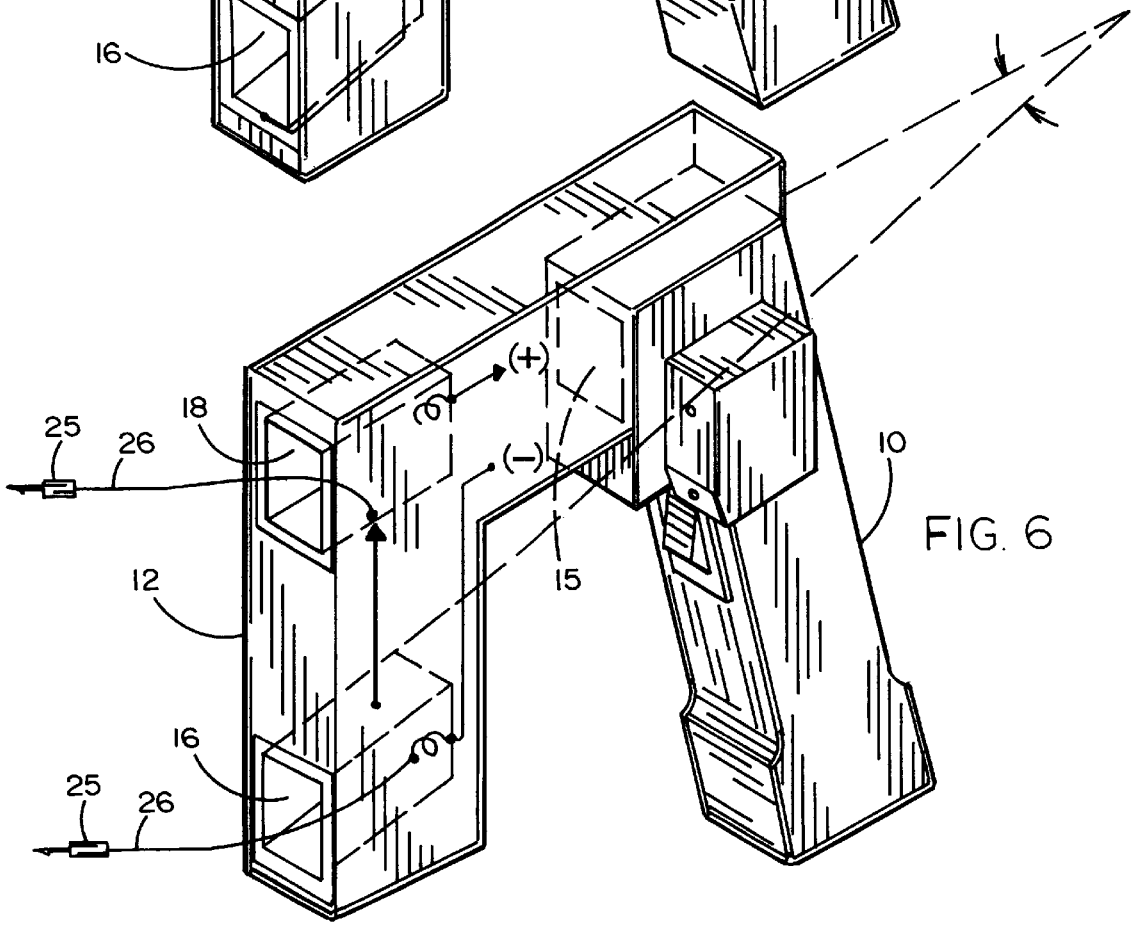

FIG. 6 illustrates the fully interconnected adapter 12 and weapon 10 with the adapter inserted into receiver 15. Cartridges (not shown) inserted into weapon chambers 16 and 18 are configured mechanically at an angle of about 5 degrees and are configured electrically in series where the ammunition cartridges become part of the weapon's detonation circuitry. When the weapon's power supply is activated, current traveling in the circuit detonates the ammunition propellant (not shown) and/or releases the ammunition propellant via intermediate means. The ammunition projectiles 25 and a large portion of both conductors 26 are expelled from the cartridge and receiver. Release of the propellant and subsequent flight of the projectiles to a remote conducting target disables the detonating branch path or paths of the circuit as current now flows more readily through the less resistive target connected path, said projectiles being spaced apart a distance greater than the longest dimension of any weapon ammunition chamber from the time of the projectile's exit from the ammunition chambers.

Figure 7:
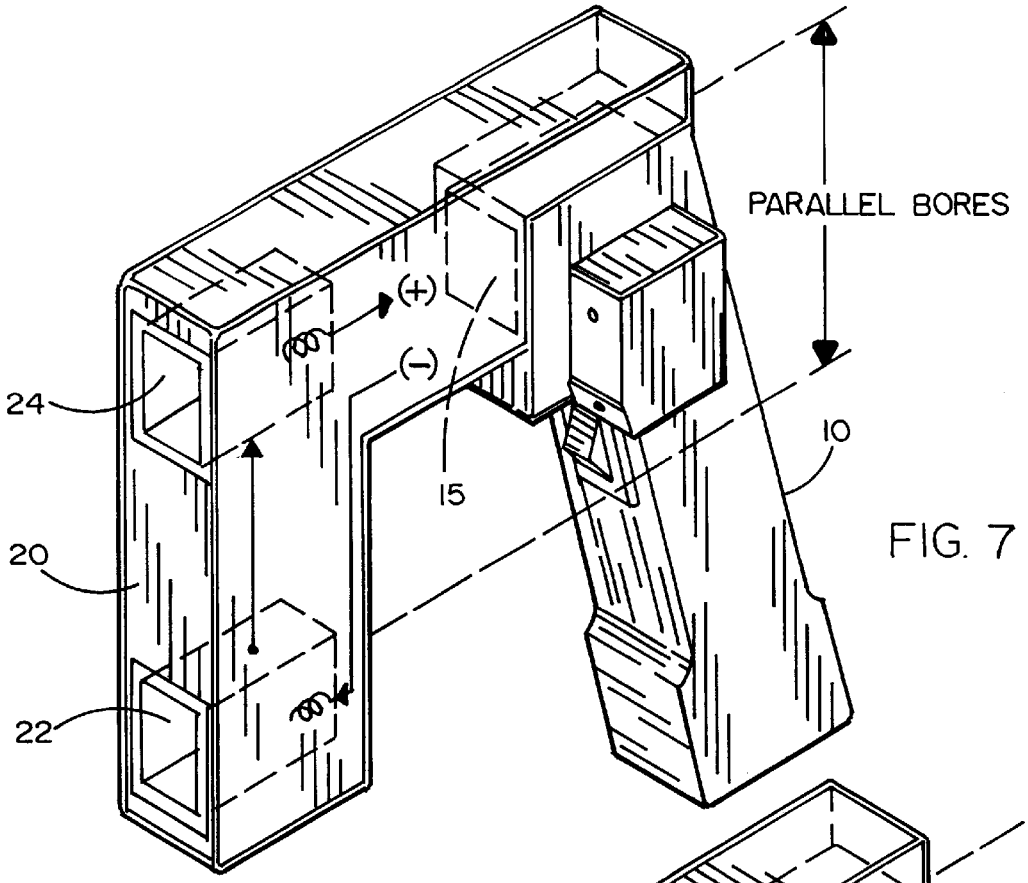
FIGS. 7 and 8 illustrate alternate embodiments of a parallel cartridge configuration of an assembled adaptor/TASER.

FIG. 7 illustrates the fully interconnected adapter 20 and weapon 10 with the adapter inserted into receiver 15. Cartridges (not shown) inserted into weapon chambers 22 and 24 are configured mechanically in parallel and are configured electrically in series. When both darts hit the target, a series connection which exists in parallel configuration with the detonation circuit is created through the target.

Figure 8:
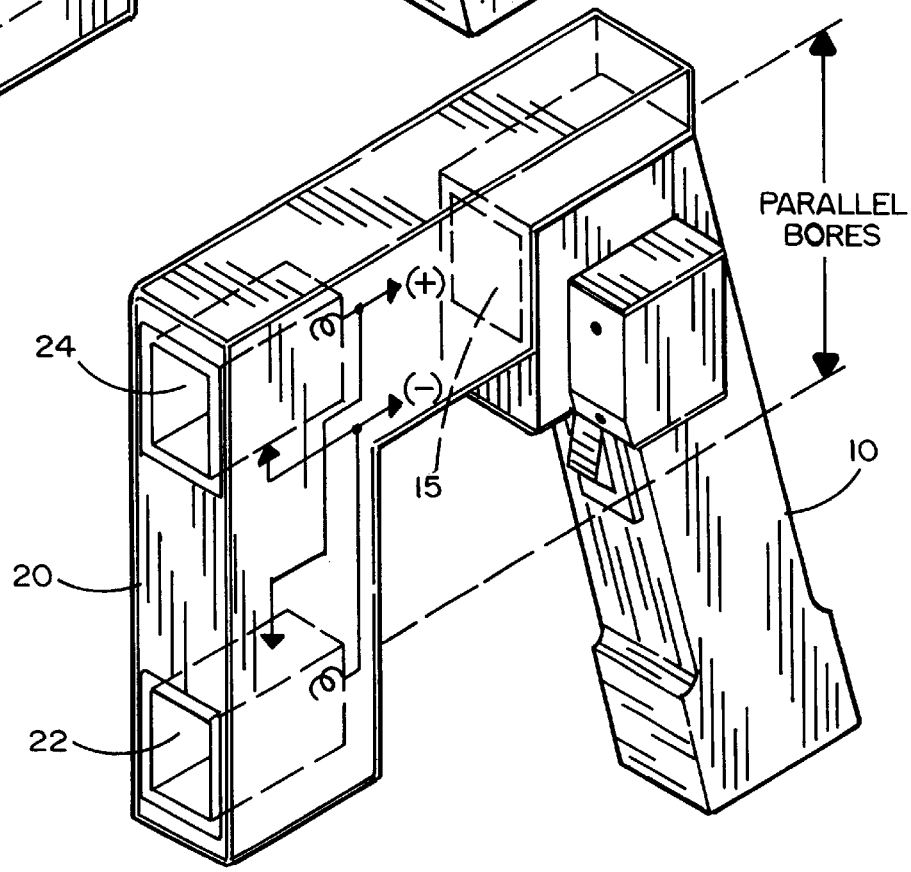

FIG. 8 illustrates the fully interconnected adapter 20 and weapon 10 with the adapter inserted into receiver 15. Cartridges (not shown) inserted into weapon chambers 22 and 24 are configured mechanically in parallel and are configured electrically in parallel. When both darts hit the target, a series connection which exists in parallel configuration with the detonation circuit is created through the target.

In all four configurations of FIGS. 5 through 8, before insertion of the cartridges or after the cartridges are activated and their respective darts have been propelled toward a target, the empty weapon chambers cause a current to pass externally between the chambers when placed adjacent to a conductive target. This permits the invention to provide effective separation for a manual contact non-lethal weapon in the event that no cartridges are loaded or the darts miss their target or otherwise fail to disable the target.

Describing the present method, two spaced apart cartridges, each containing a propellant, a projectile, means for directing the propellant force to the projectile, means for directing the projectile, and a conductor which is connected to the projectile at one termination and is a contact at its other termination, are placed respectively into the upper and lower chambers of one of the weapon receivers illustrated in FIGS. 5, 6, 7 and 8, where the ammunition cartridges become part of the weapon's detonation circuitry. When the weapon's power supply is activated, current traveling in the parallel circuit detonates the ammunition propellant and/or releases the ammunition propellant via intermediate means.

The projectiles and a large portion of both conductors are expelled from the cartridge and weapon. Release of the propellant and the subsequent flight of the projectiles to a remote conducting target disables the detonating branch path or paths of the circuit as current now flows more readily through the less resistive target connected path, said darts being spaced apart a distance greater than the longest dimension of any weapon ammunition chamber from the time the darts exit from the ammunition chambers.

Figure 9:
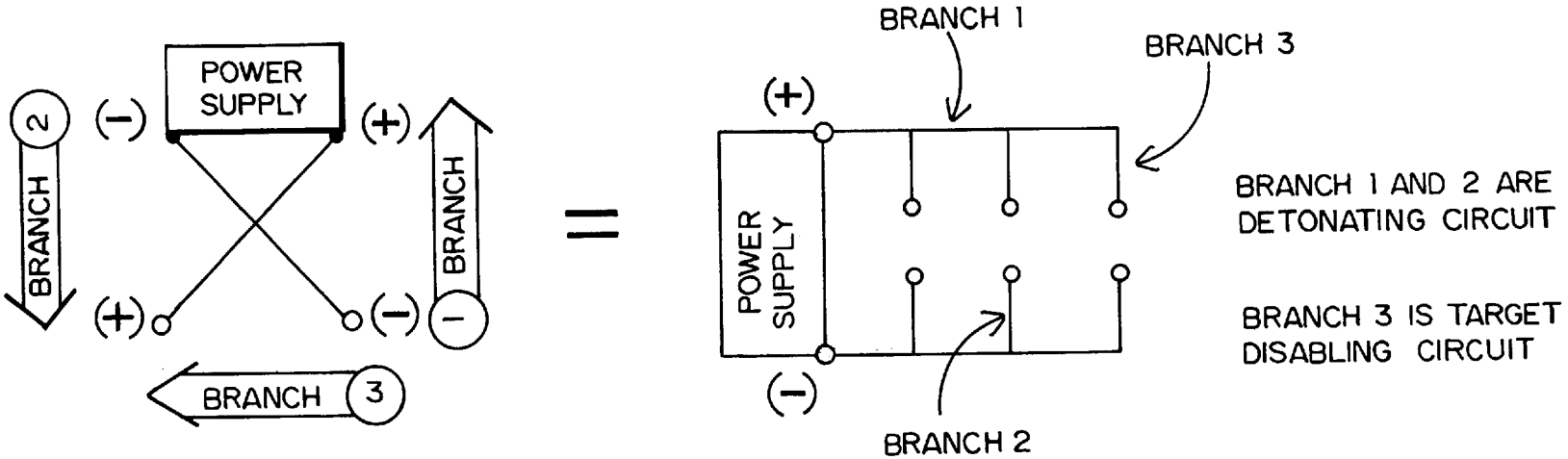
FIG. 9 illustrates, schematically, the electrical operation of the method with the weapon receiver illustrated in FIG. 5.
Figure 10:
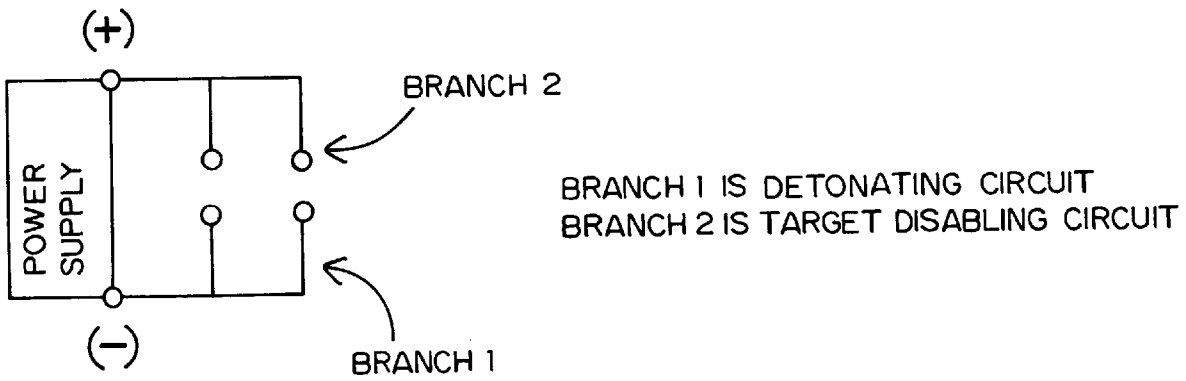
FIG. 10 illustrates, schematically, the electrical operation of the method with the weapon receiver illustrated in FIG. 6.

FIG. 9 illustrates, schematically, the electrical operation of the method with the weapon receiver illustrated in FIG. 5. FIG. 10 illustrates, schematically, the electrical operation of the method with the weapon receiver illustrated in FIG. 6.

Having thus disclosed a number of preferred embodiments of the invention, it being understood that numerous modifications and additions are contemplated and will now be apparent to those having benefit of the above disclosure, what is claimed is:

1. An electrical discharge weapon which employs cartridges which are selectively activated to propel wire tethered electrode darts toward a live target for imparting an electrical shock between two points on the target; the weapon comprising:

a receiver and two ammunition chambers spaced apart, each such chamber having electrodes for activating propulsion of a unitary respective tethered dart; at least one of said electrodes in each such chamber providing an electrical discharge to a target in contact with said weapon when said chambers are empty of cartridges;

said ammunition chambers being formed in a portion detachable from said receiver.

2. An electrical discharge weapon comprising:

a first portion operable to generate an energizing signal for the propulsion of a pair of tethered electrode darts for cooperatively delivering an electrical stun signal upon a live target, said first portion defining a receiver chamber;

a second portion detachably coupled to said first portion, said second portion defining a pair of ammunition chambers spaced one from the other, each said ammunition chamber being electrically coupled to said receiver chamber and having a pair of electrodes for activating propulsion of one said tethered electrode dart therefrom responsive to said energizing signal, said ammunition chambers being operable independent of said tethered electrode darts to impart an electrical discharge responsive to said energizing signal upon a target making concurrent contact therewith.

* * * * *